US007976016B2

(12) United States Patent
Kinoshita

(10) Patent No.: US 7,976,016 B2
(45) Date of Patent: Jul. 12, 2011

(54) MEDIUM TRANSFERRING MECHANISM AND MEDIUM PROCESSOR WITH MEDIUM INSERTING PORTION

(75) Inventor: Yoshiki Kinoshita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 506 days.

(21) Appl. No.: 12/072,750

(22) Filed: Feb. 28, 2008

(65) Prior Publication Data

US 2008/0308994 A1 Dec. 18, 2008

(30) Foreign Application Priority Data

Feb. 28, 2007 (JP) ..... 2007-048621

(51) Int. Cl.
*B65H 1/02* (2006.01)

(52) U.S. Cl. ..... 271/149; 271/145

(58) Field of Classification Search ..... 271/145, 271/149, 157, 3.12, 121; 235/475, 483–486, 235/375, 379, 449; 382/135, 137, 139, 182, 382/320; 399/393; 400/73; 275/226; 360/2, 360/69

See application file for complete search history.

(56) References Cited

U.S. PATENT DOCUMENTS

| | | | | |
|---|---|---|---|---|
| 5,438,186 | A * | 8/1995 | Nair et al. | 235/449 |
| D507,271 | S * | 7/2005 | Panini | D14/386 |
| 7,090,131 | B2 * | 8/2006 | Natsuno | 235/449 |
| 2005/0035531 | A1 * | 2/2005 | Sasaki et al. | 271/126 |
| 2006/0210342 | A1 * | 9/2006 | Fujikawa et al. | 400/586 |
| 2006/0237897 | A1 * | 10/2006 | Terao et al. | 271/145 |

FOREIGN PATENT DOCUMENTS

| | | |
|---|---|---|
| EP | 1675072 | 6/2006 |
| JP | 07-244709 | 9/1995 |
| JP | 2004-206362 | 7/2004 |
| JP | 2005-289625 | 10/2005 |
| JP | 2005-314053 | 11/2005 |
| WO | WO-92/01618 | 2/1992 |

OTHER PUBLICATIONS

European Search Report Re: EP 08 00 3589 dated Apr. 6, 2009.

* cited by examiner

*Primary Examiner* — Jeremy Severson

(74) *Attorney, Agent, or Firm* — Nutter McClennen & Fish LLP; John J. Penny, Jr.; Michael P. Visconti, III

(57) ABSTRACT

A medium transferring mechanism that includes a medium inserting portion into which a sheet medium is inserted, the medium inserting portion defined by a bottom face and by a first side face and a second side face which extend from the bottom face and are opposed to each other; wherein a first guide face extending toward the first side face is formed at a forward end portion of the second side face; a second guide face extending from the second side face so as to gradually get close to a medium transferring path towards a medium transferring direction is formed above the first guide face; and a third guide face inclined downward from a lower edge of the second guide face toward an upper edge of the first guide face, is formed between the first guide face and the second guide face.

11 Claims, 5 Drawing Sheets

MEDIUM TRANSFERRING MECHANISM AND MEDIUM PROCESSOR WITH MEDIUM INSERTING PORTION

Priority is claimed under 35 U.S.C. §119 to Japanese Patent Application No. 2007-048621 filed Feb. 28, 2007, the disclosure of which, including specification, drawings and claims, is incorporated herein by reference in its entirety.

BACKGROUND

The present invention relates to a medium transferring mechanism mounted on a medium processor such as a check processor, printer, scanner or magnetic reader used for separating and transferring sheet-shaped mediums such as checks or recording sheets one by one. More particularly, the present invention relates to a medium transferring mechanism in which a shape of a medium inserting portion, into which sheet-shaped mediums are inserted, is improved so that the sheet-shaped mediums can be smoothly transferred.

In financial institutions such as a bank, marketable securities, which have been brought in, such as a check, a bill and so forth, are processed by a check processor so as to read out surface images and magnetic ink characters on the marketable securities. As a result of the reading, the marketable securities are classified. Since the electronic settlement has been widely accepted, the image data and the magnetic ink characters, which have been read out, are subjected to computer processing so as to manage the marketable securities. Japanese Patent Publication No. 2004-206362A discloses a similar check processor.

In general, a check inserting portion of the check processor is formed into a recessed-shape of a predetermined width, the upper and the rear portion of which are open. Therefore, a bundle of checks are inserted into the check inserting portion of the check processor from the upper or the rear side or from the obliquely upper side. In the check inserting portion, a medium separating mechanism is arranged which includes a feeding roller and a pressing member. Checks inserted into the check inserting portion are pressed against the feeding roller by the pressing member and a check coming into contact with the feeding roller is transferred from the check inserting portion into a narrow conveyance passage by the feeding roller.

In this case, it is desirable that the check inserting portion has a shape into which checks can be inserted into a proper position by a simple handling operation. For example, it is desirable that even when the checks are inserted by a single hand, it is possible to insert the checks into the check inserting portion under the condition that forward end portions of the checks in the transferring direction are arranged in order.

In the case where checks of a large size are inserted into the check inserting portion, upper end portions of the checks are protruded upward. In this case, when the checks are thin and tender, the portions of the checks protruding upward fall down in the lateral direction. In the case where the checks are transferred from a wide check inserting portion into a narrow check conveyance passage in this state, at a position before the check conveyance passage, upper side portions of the checks, which have fallen down, collide with a side of the check inserting portion. Therefore, it becomes impossible to transfer the checks anymore, that is, the checks come into a jamming state. In the case where folds are formed in the lateral direction in the upper end portions of the checks, the same problems may be encountered.

SUMMARY

It is therefore an object of at least one embodiment of the invention to provide a medium transferring mechanism having a medium inserting portion in which sheet-shaped mediums can be inserted into a proper position by a simple handing operation and it is possible to smoothly transfer even wide sheet-shaped mediums or tender sheet-shaped mediums.

In order to achieve the above objects, according an aspect of at least one embodiment of the present invention, there is provided a medium transferring mechanism for transferring a sheet medium in a medium transferring direction, comprising: a medium inserting portion into which the sheet medium is inserted in an upright posture, the medium inserting portion defined by a bottom face and by a first side face and a second side face which are raised from the bottom face and opposed to each other; a medium transferring path formed at a forward end of the medium inserting portion, and operable to guide the sheet medium in the medium transferring direction; a feeding member disposed at the side of the first side face and operable to feed the inserted sheet medium to the medium transferring path; and a pressing member disposed at the side of the second side face and operable to press the inserted sheet medium against the feeding member, wherein: a first guide face extending toward the first side face is formed at a forward end portion of the second side face; a second guide face extending from the second side face so as to gradually get close to the medium transferring path towards the medium transferring direction is formed above the first guide face; and a third guide face inclined downward from a lower edge of the second guide face toward an upper edge of the first guide face, is formed between the first guide face and the second guide face.

In the medium inserting portion of the aspect of the present invention, in the forward end portion of the second side face on which the pressing member is arranged, the first side face is formed which extends toward the first side face. When a bundle of sheet medium is inserted into the medium inserting portion, the forward end portion of the sheet medium is made to collide with the first guide face. In this way, the sheet medium inserted into the medium inserting portion can be positioned in the longitudinal direction (the sheet-shaped medium transferring direction). In this case, it is sufficient that the forward end portion of the sheet medium is pressed while an operator is seeing the first guide face. Therefore, the operator can immediately understand the inserting position of the sheet medium. Further, the operator can immediately confirm whether or not the sheet medium is properly inserted into the medium inserting portion.

In the medium inserting portion of the aspect of the present invention, the second guide face is formed above the first guide face, which extends from the second side face so as to gradually get close to the medium transferring path towards the medium transferring direction. The sheet medium is pressed against the feeding member by the pressing member. That is, the sheet medium is pressed to the first side face and transferred to the medium transferring path along the first side face. Since the first guide face, which extends toward the first side face, is formed on the second side face opposed to the first side face, in the case where the upper side portion of the transferred sheet medium falls down laterally or the upper side portion of the transferred sheet medium are bent in the lateral direction, there is a possibility that these bent portions collide with the first face and it becomes impossible to transfer the sheet medium. In the case where a thin and tender sheet medium or a wide sheet medium is transferred, the sheet medium tends to be put into the above state. However, in the aspect of the present invention, the second guide face, which extends from the second side face so as to gradually get close to the medium transferring path towards the medium transferring direction, is formed above the first guide face. Therefore, the upper side portion of the sheet medium, which has fallen down or bent in the lateral direction, can be smoothly guided in the medium transferring direction by the second guide face. Therefore, when a position of the height of the second guide face is properly set, it is possible to positively prevent the occurrence of such a problem that the sheet medium can not be transferred while the upper side portion of the sheet medium is colliding with the first guide face.

In the medium inserting portion of the aspect of the present invention, between the first guide face and the second guide face, a third guide face, which is inclined downward from the lower edge of second guide face to the upper edge of the first guide face, is formed. Therefore, when the sheet medium is inserted from the upper side and the forward end portion of the sheet medium is located on the front side of the first guide face, it is guided by the second guide face and the third guide face into a proper position in the medium inserting portion. Accordingly, the sheet medium can be put onto the operator's side of the first guide face.

A fourth guide face may be formed so as to continue from the first face and extend so that an interval between the fourth guide face and a forward end portion of the first side face, which is opposed to the fourth guide face is gradually decreased towards the medium transferring direction. According to the above configuration, the sheet medium transferred by the feeding member is guided by the fourth guide face on the second side face and the forward end portion of the first side face, which is opposed to the fourth side face, and smoothly transferred to the medium transferring path toward the narrow conveyance passage.

A fourth guide face may be formed in at least one of an upper end portion of the first side face and an upper end portion of the second side face, and the fourth guide face may be upwardly inclined in a direction separated from the other side face. With the above configuration, in the case where the sheet medium is inserted from the upper side, the sheet medium can be smoothly inserted into the medium inserting portion since the upper side opening width of the medium inserting portion is expanded by the fourth guide face.

A fourth guide face may be formed in at least one of a rear end portion of the first side face and a rear end portion of the second side face, and the fourth guide face may be rearwardly inclined in a direction separated from the other side face. With the above configuration, in the case of inserting the sheet medium from the rear side, it is possible to smoothly insert the sheet medium into the medium inserting portion since the opening width on the rear side of the medium inserting portion is expanded by the fourth guide face. When the fourth guide face is formed at rear end portion together with another fourth guide face formed at the upper end portion, the sheet medium can be smoothly inserted into the medium inserting portion even in the case of obliquely inserting the sheet medium from the rear upper side.

Heights of the first side face and the second side face measured from the bottom face may be increased towards the medium transferring direction. Since the heights in the front end sides of the first and the second side faces are large, at the time of transferring the wide sheet medium, while the sheet medium, the upper end of which has fallen down in the lateral direction are being raised, it is possible to transfer the sheet medium to the medium transferring path. Accordingly, even the wide sheet medium, the width of which is larger than the heights of the first and the second side face, can be smoothly transferred.

The medium transferring mechanism may further comprise a guide plate attached to a rear end of the bottom face of the medium inserting portion and capable of being drawn out rearwardly. When a long sheet medium is inserted into the medium inserting portion, the guide plate may be drawn out rearwardly so as to extend the length of the bottom face of the medium inserting portion. Due to the above structure, in the case where the long sheet medium is inserted, it is possible to prevent the sheet medium from dropping down from the rear side opening of the medium inserting portion. Further, it is possible to prevent the inserted sheet medium from being put into an unstable state. When the guide plate is not needed, it may be accommodated, that is, there is no possibility that operation is disturbed by the guide plate.

According to another aspect of at least one embodiment of the invention, there is provided a medium processor comprising: the above described medium transferring mechanism; a medium conveyance passage for conveying the sheet medium transferred from the medium transferring mechanism; a conveyance roller operable to convey the sheet medium transferred into the medium conveyance passage; an information reading section operable to read information recorded in the sheet medium conveyed in the medium conveyance passage; and a medium discharging portion operable to receive the sheet medium discharged from the conveyance passage after the completion of reading information.

In the medium processor of the another aspect of at least one embodiment of the present invention, there is no possibility that the sheet medium inserted into the medium inserting portion of the medium transferring mechanism are jammed and can not be transferred. Therefore, the sheet medium can be effectively processed.

In the medium transferring mechanism of the aspects of the present invention, in the medium inserting portion having a medium separating mechanism provided with the feeding member and the pressing member, the first guide face is formed on the second side face on which the pressing member is arranged. Therefore, by inserting the sheet medium toward the first guide face, it is possible to insert the sheet medium to the proper inserting position. Further, since the second guide face is formed above the first guide face, the sheet medium can be smoothly transferred.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figures 1A, 1B:
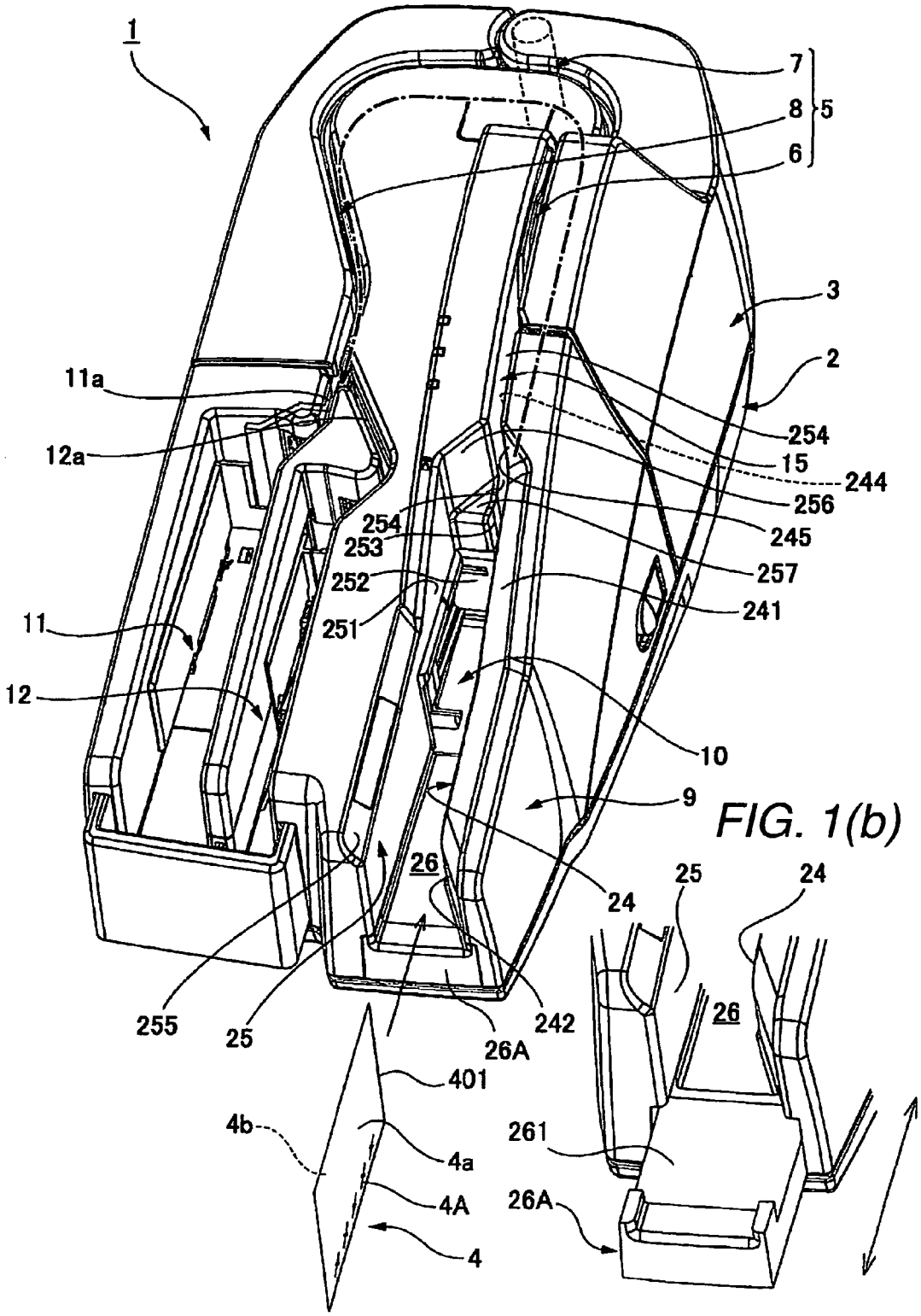
FIGS. 1(*a*) and (*b*) are perspective views of a check processor according to an embodiment of the present invention.

Hereinafter, referring to the drawings, an embodiment of a check processor having a medium transferring mechanism, to which the present invention is applied, will be explained below.

As shown in FIGS. 1(*a*) and 2, the check processor 1 includes: a main body case 2; and a cover case 3 for covering an upper side of the main body case 2. Parts are incorporated into the main body case 2 and the cover case 3. On the cover case 3, a conveyance passage 5 for conveying a check 4 (sheet-shaped medium), which is formed out of a narrow vertical groove, is formed. When a view is taken from above, the conveyance passage 5 is approximately formed into a U-shape. The conveyance passage 5 includes: a linear upstream side conveyance passage portion 6; a curved conveyance passage portion 7 continuing to the linear upstream side conveyance passage portion 6; and a little curved downstream side conveyance passage portion 8 continuing to the curved conveyance passage portion 7.

An upstream end of the upstream side conveyance passage portion 6 is communicated with a check inserting portion 10 (medium inserting portion) formed out of a wide vertical groove in a check transferring device 9. A downstream end of the downstream side conveyance passage portion 8 is connected to the first and the second check discharging portion 11, 12, which are respectively formed out of a wide vertical groove, through the branch passages 11*a*, 12*a* branching to the right and left.

Concerning the check 4 to be read, magnetic ink characters 4A are printed in a lower end portion on the surface 4*a*. On the surface 4*a*, an amount of money, a drawer of the check, a number and a signature are described on the background of a predetermined pattern. On the reverse side 4*b*, an endorsement section is provided.

Figure 3:
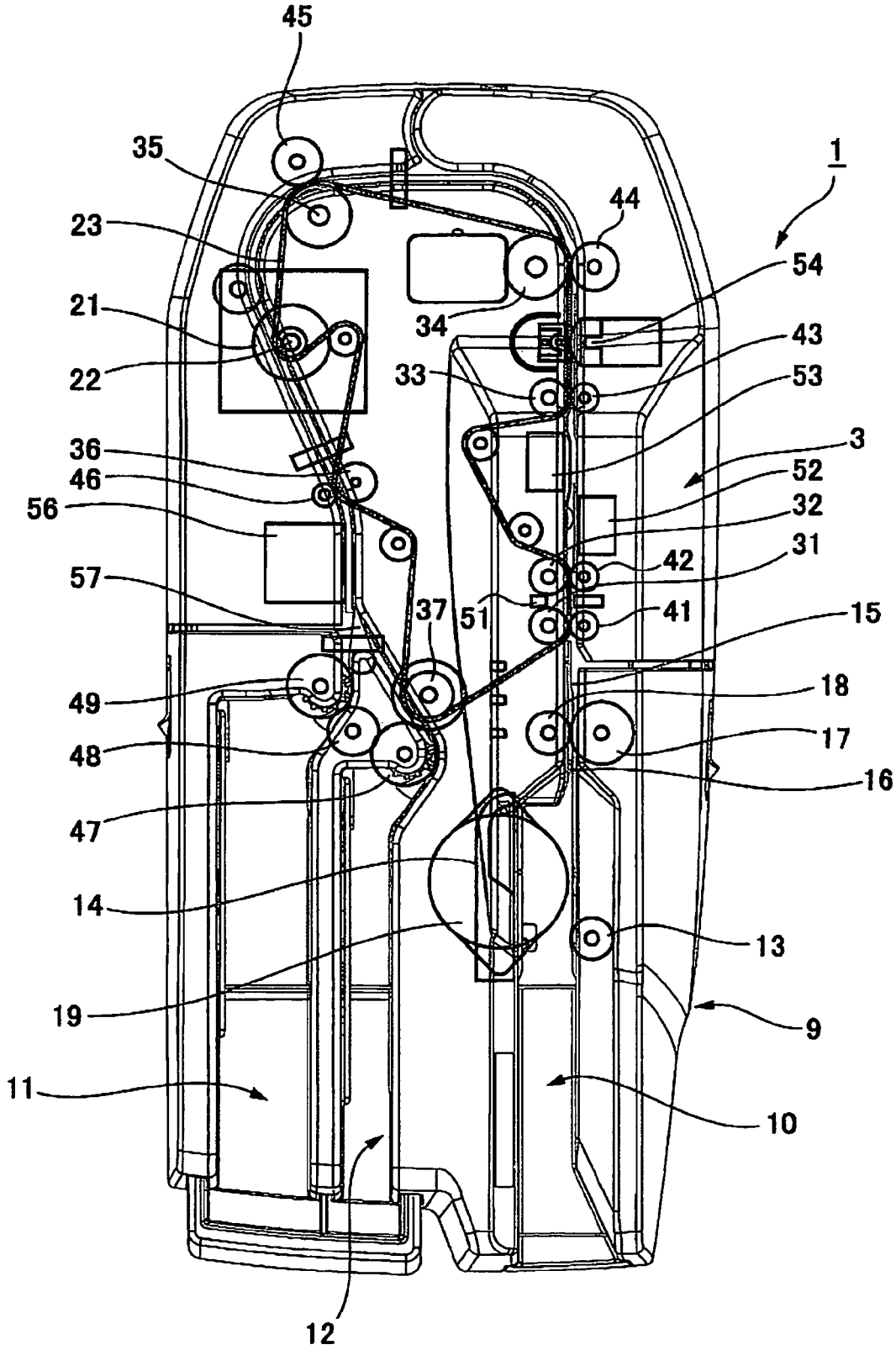
FIG. 3 is a schematic illustration showing an inner structure of the check processor shown in FIG. 1(*a*)
Figure 4:
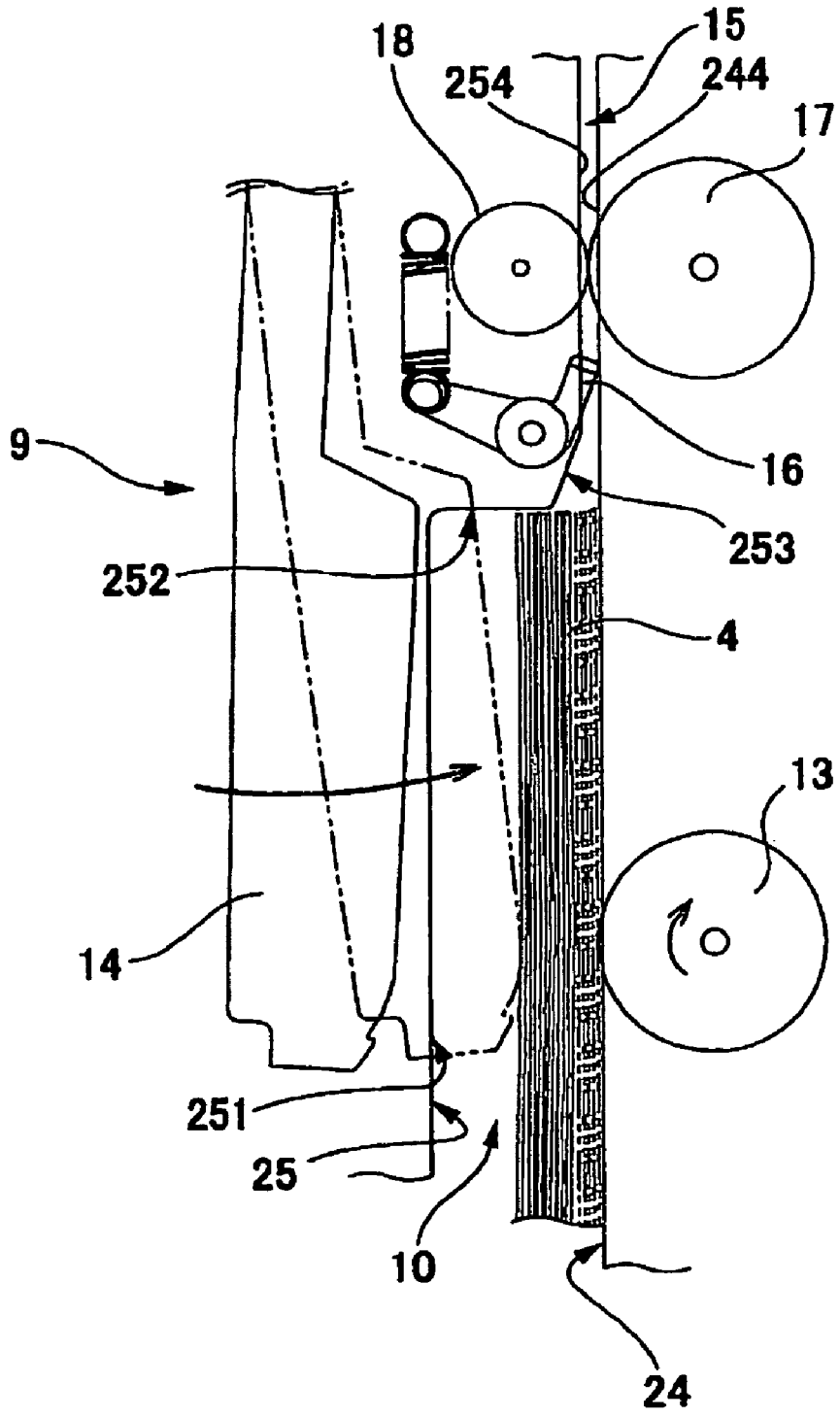
FIG. 4 is a partial schematic illustration showing a check transferring mechanism of the check processor shown in FIG. 1(*a*)

As shown in FIGS. 3 and 4, the check transferring device 9 includes: a feeding roller (feeding member) 13 for transferring the checks 4, which have been inserted into the check inserting portion 10 being on top of each other, toward the conveyance passage 5; and a pressing member 14 for pressing the checks 4 against the feeding roller 13. In a check transferring path 15 for transferring the checks 4, which have been drawn out by the feeding roller 13, into the conveyance passage 5, a separation pad 16, which is a separation mechanism for separating the checks one by one and transferring them into the conveyance passage 5, and a pair of separation rollers including a separation roller 17 and a retard roller 18 are arranged. The feeding roller 13, the separation roller 17 and the pressing member 14 are driven by the transferring motor 19 shown in FIG. 3.

As shown in FIG. 3, the conveyance mechanism for conveying the checks 4 along the conveyance passage 5 includes: a conveyance motor 21; a drive roller 22 attached to a rotary shaft of this conveyance motor 21; conveyance rollers 31 to 37 arranged along the conveyance passage 5; and pressing rollers 41 to 47 which are pressed against the conveyance rollers 31 to 37, respectively, and turned together. A rotation of the pressing roller 47 is transmitted to the transferring roller 49 through the transmission gear 48. A rotation of the conveyance motor 21 is transmitted to the conveyance rollers 31 to 37 through the endless belt 23.

The conveyance rollers 31 to 34 are respectively arranged at the upstream end in the upstream side conveyance passage portion 6, the halfway position and the boundary position with the curved conveyance passage portion 7. The conveyance roller 35 is arranged at a position on the downstream side of the curved conveyance passage portion 7. The conveyance roller 36 is arranged at a position in the halfway of the downstream side conveyance passage portion 8. The conveyance roller 37 is arranged before the second check discharging portion 12. The transferring roller 49 is arranged before the first check discharging portion 11.

Between the conveyance rollers 31 and 32 in the upstream side conveyance passage portion 6, a magnet 51 for magnetizing magnetic ink characters is arranged. Between the conveyance rollers 32 and 33, a surface side contact image scanner 52, which is a surface side image reading means, a the reverse side contact image scanner 53, which is a reverse side image reading means, are arranged. Between the conveyance rollers 33 and 34, a magnetic head 54 for reading magnetic ink characters is arranged.

On the downstream side of the conveyance roller 36 in the downstream side conveyance passage portion 8, a printing mechanism 56 is arranged. The printing mechanism 56 can be moved by a drive motor (not shown) between the printing position pressed against the check 4 and the waiting position retracted from this printing position. The printing mechanism 56 may be a stamping mechanism that conducts printing operation on the check 4 when it is pushed by a plunger.

In branch passages 11*a*, 12*b* that branch from a downstream end of the downstream side conveyance passage portion 8, a changeover plate 57 is arranged which is controlled by a drive motor not shown. By the changeover plate 57, the check 4 can be discharged to one of the first and the second check discharging portion 11, 12.

An action of processing the checks 4 by the check processor 1 will be briefly explained below. The checks 4, which have been inserted into the check inserting portion 10 of the check transferring device 9, are transferred to the check transferring passage 15 by the feeding roller 13 and then transferred one by one to the upstream side conveyance passage portion 6 of the conveyance passage 5. While a surface side image and a reverse side image on the check 4, which has been transferred to the upstream side conveyance passage portion 6, are being read out by the surface side contact image scanner 52 and the reverse side contact image scanner 53, the check 4 is conveyed. Next, while magnetic ink characters are being read out by the magnetic head 54, the check 4 is conveyed.

Concerning the check 4 on which reading has been properly executed by the surface side contact image scanner 52, the reverse side contact image scanner 53 and the magnetic head 54, characters of "Electronic settlement has been completed." are printed on the surface by the printing mechanism 56 arranged in the downstream side conveyance passage portion 8. Then, the check 4 is discharged to the first check discharging portion 11 side through the branch passage 11*a*. The check 4, on which reading has not been properly conducted, is discharged to the second check discharging portion 12 side through the branch passage 12*a* without being printed by the printing mechanism 56.

(Check Inserting Portion)

Figure 2:
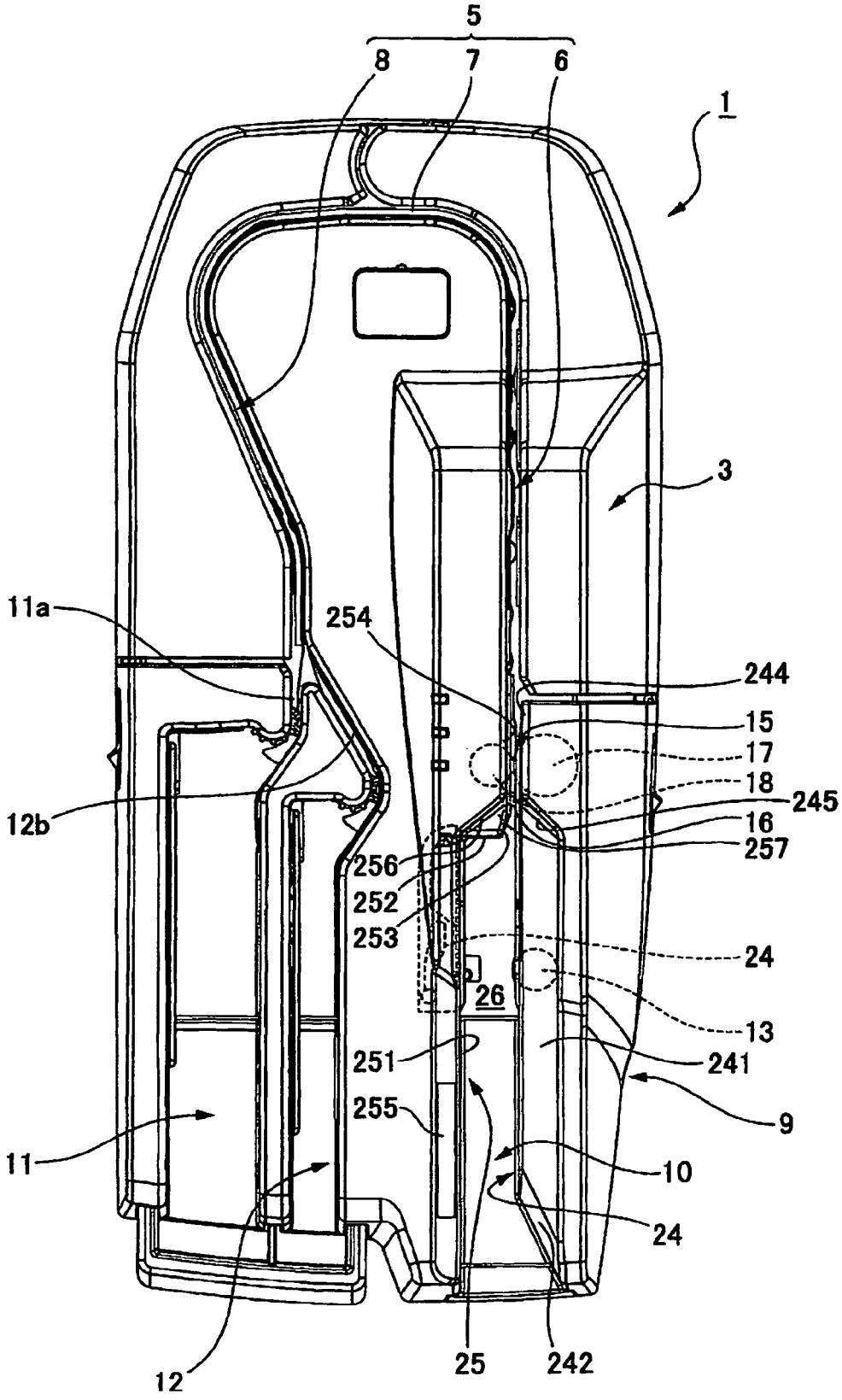
FIG. 2 is a plan view of the check processor shown in FIG. 1(*a*)

Referring to FIGS. 1, 2 and 4, the check inserting portion 10 of the check transferring device 9 will be explained below. The check inserting portion 10 is essentially formed by a first side 24 and a second side 25, which are arranged on the right and left side of the check inserting portion 10 and by a bottom face 26. The first side 24 is a linear flat vertical face substantially vertically rising from the bottom face 26. The first side 24 extends in the check transferring direction.

The second side 25 includes a parallel guide face 251 arranged in parallel with the first side 24 at a predetermined interval. To a front end portion of this parallel guide face 251, a check colliding face (first guide face) 252, which is bent by a substantial angle of approximately 90° toward the first side 24, that is, which is extended in a direction perpendicular to the check transferring direction, is attached. To an end portion of this check colliding face 252, a front end side guide face (fourth guide face) 253, which gradually comes close to the first side 24, extends. Continuously to a forward end portion of this front end side guide face 253, a transferring side parallel guide face 254, which is opposed to a front end side portion 244 of the first side 24 at a close interval, is formed.

By the front end side portion 244 and the transferring side parallel guide face 254, the check transferring passage 15 is formed. A forward end portion of the check transferring passage 15 is connected to an upstream end portion of the upstream side conveyance passage portion 6 of the conveyance passage 5.

In this case, as can be seen in FIGS. 1(*b*) and 5(*a*), heights of the first side 24 and the second side 25, which are arranged on the right and left of the check inserting portion 10, are the smallest at the rear end of the check inserting portion 10. The heights are gradually increased toward the front (in the direction of transferring the checks). From an approximate halfway position in the longitudinal direction of the check inserting portion 10, the heights are increased by a larger inclination angle. In an upper end portion of the first side 24, an upper end inclination face (first fifth guide face) 241 for guiding check insertion, which is inclined in a direction extending away from the second side 25 in the upper direction, is formed. In a rear end portion of the first side 24, a rear end inclination face (sixth guide face) 242 for guiding check insertion, which is inclined in a direction extending away from the second side 25 to the rear direction, is also formed. The upper end inclination face 241 for guiding a check insertion and the rear end inclination face 242 for guiding check insertion smoothly are continuous to each other. In the same manner, in an upper end portion of the second side 25, in its rear side portion, an upper end inclination face (second fifth guide face) 255 for guiding check insertion, which is inclined in a direction extending away from the first side 24 in the upper direction, is formed. Further, a height of the parallel guide face 251 having an upper end inclination face 255 for guiding a check insertion is formed to be higher than the height of the opposing portion of the main body case 2 on the first side 24.

As can be seen in FIGS. 1(*a*), 1(*b*) and 2, a height of the check colliding face 252 is approximately two thirds of the height of the second side 25. On the upper side, a guide face (second guide face) 256 for transferring a check, which continues to an upper side portion of the parallel guide face 251 and extends onto the first side 24 being bent by an angle of approximately 45° with respect to the check transferring direction, is formed. A rear edge of the guide face 256 for transferring a check is connected to a rear end of the upper side portion of the transferring side parallel guide face 254.

Between the check transferring guide face 256 and the check colliding face 252 located on its lower side and between the check transferring guide face 256 and the front end side guide face 253, a triangular inclination upper end face (third guide face) 257, which is inclined downward, is formed from a lower edge of the check transferring guide face 256 to the check colliding face 252.

Further, as shown in FIG. 1(*a*), at a rear end portion of the check inserting portion 10, a horizontal guide plate 26A capable of being horizontally drawn out to the rear is attached. When the horizontal guide plate 26A is drawn out to the rear, as shown in FIG. 1(*b*), a horizontal guide face 261 of a predetermined length, which is located at a lower position, can be formed continuous to the rear end portion of the bottom face 26. In the case where the horizontal guide 26A is not used, it is possible to accommodate the horizontal guide plate 26A in the check inserting portion 10 as shown in FIG. 1(*a*).

Figure 5A:
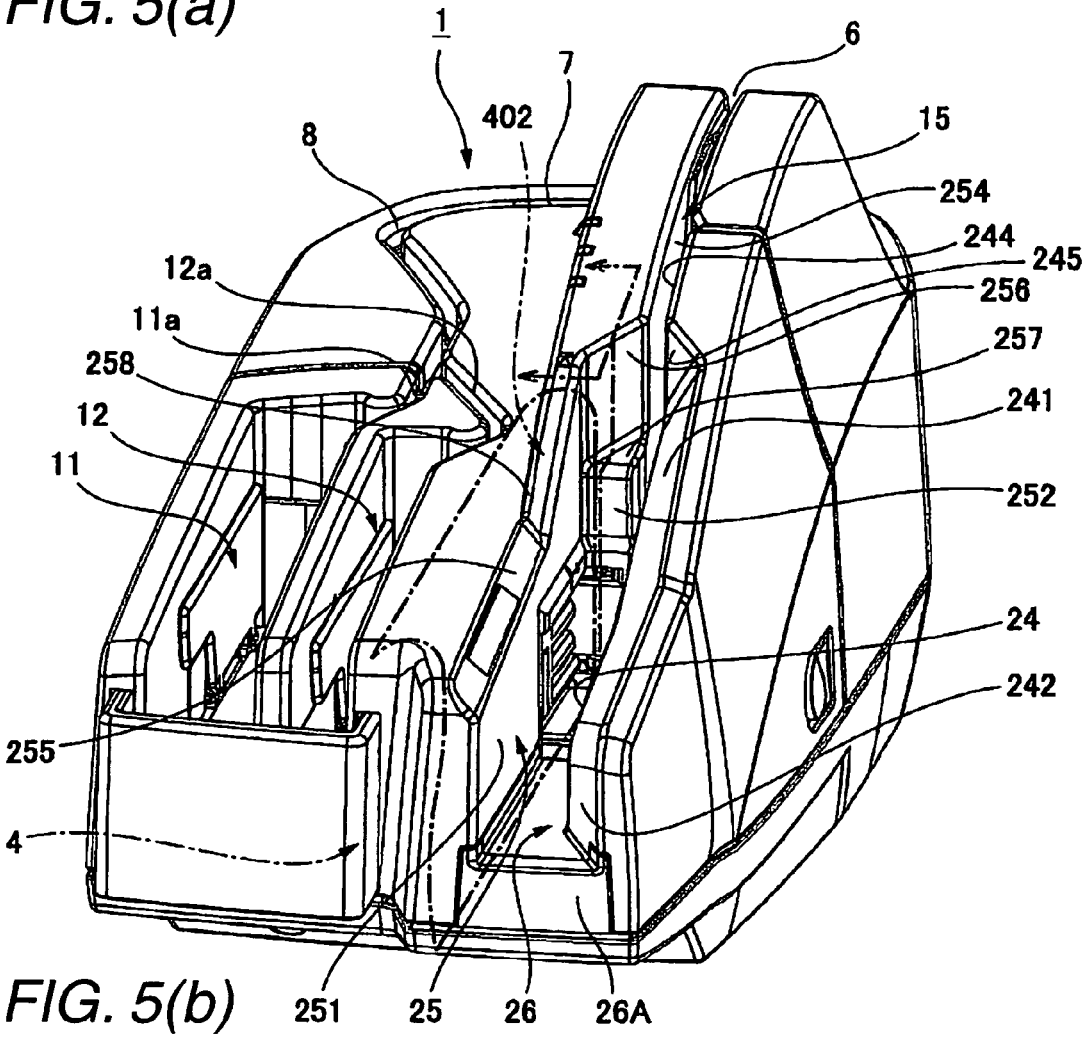
FIGS. 5(*a*) and (*b*) are schematic illustrations showing a check inserting action into a check inserting portion according to the embodiment.
Figure 5B:
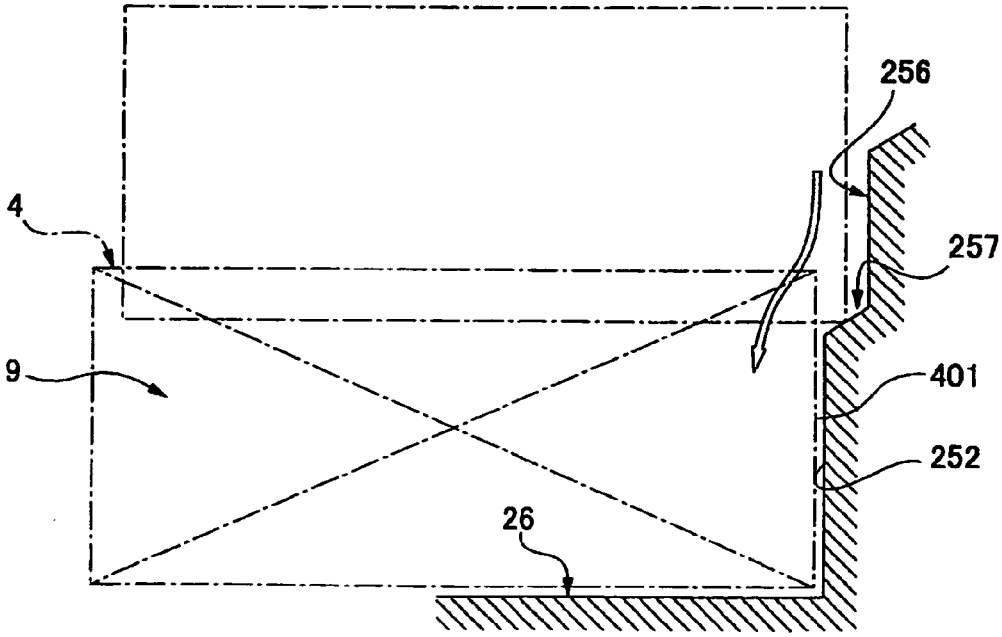

Referring to FIGS. 5(*a*) and 5(*b*), explanations will be made into the operation of inserting the checks 4 into the check inserting portion 10 and the action of transferring the inserted checks 4. Although the number of the inserted checks 4 is not limited to one or plurality, the check inserting portion 10 is composed so that a bundle of checks, the number of which is approximately 50 or approximately 100, can be smoothly inserted. An interval between the first side 24 and the second side 25, which are arranged on the right and the left, is determined so that even 100 sheets of checks can be inserted into the check inserting portion 10 of the present embodiment.

First, in the case of inserting the checks 4 into the check inserting portion 10, the insertion is executed so that the forward end portions 401 of the checks 4 can collide with the check colliding face 252 in any of the cases in which the checks 4 are inserted from the upper side, the checks 4 are inserted from the rear side and the checks 4 are obliquely inserted from the upper side. Alternatively, after the checks 4 have been inserted into the check inserting portion 10, the checks 4 are pushed to the front side so that the forward end portions 401 of the checks 4 can collide with the check colliding face 252. Due to the foregoing, the checks 4 are positioned in the check inserting portion 10 under the condition that the forward end portions of the checks 4 are arranged in order.

In the case where the checks 4 are inserted from the upper side, they can be positively and smoothly inserted into the check inserting portion 10 as follows. The upper end inclination faces 241, 255 for guiding the checks to be inserted are formed in upper end portions of the first side 24 and the second side 25 on the right and left of the check inserting portion 10, respectively. An opening width of the upper end portions of the upper end inclination faces 241, 255 for guiding a check insertion is twice as wide as the interval between the first side 24 and the second side 25 on the right and left. In other words, the opening width on the upper side, from which the checks are inserted into the check inserting portion 10, is formed wide. Therefore, lower end portions of the checks 4 inserted are guided by the upper end inclination faces 241, 255 for guiding a check insertion. Accordingly, the checks can be positively, smoothly inserted into the check inserting portion 10. In the same manner, in the case where the checks 4 are inserted from the rear side, the rear end inclination face 242 for guiding a check insertion is formed at the rear end portion of the first side 24. Therefore, an opening width to the check inserting portion 10 is formed wide.

Since the opening width to the check inserting portion 10 is formed wide by the upper end inclination faces 241, 255 for guiding a check insertion and the rear end inclination face 242 for guiding a check insertion, the checks 4 can be smoothly inserted in any of the cases in which the checks 4 are inserted from the upper side, the checks 4 are inserted from the rear side and the checks 4 are obliquely inserted from the upper side.

A height of the parallel guide face 251, on which the upper end inclination face 255 for guiding a check insertion is higher than an opposing portion of the main body case 2 on the first side 24 and the upper end inclination face 255 for guiding a check insertion is located at a higher position. Therefore, when the checks 4 are moved from the right side of FIG. 1(*a*) so that lower end portions of the checks 4 can be parallel with the height of the main body case 2, the side of the check 4 can be contacted with the parallel guide face 251. Accordingly, the checks 4 can be easily inserted into the check inserting portion 10. In the present embodiment, in the case of a thick bundle of checks 4, when the checks 4 are moved from the right upper portion so that the checks 4 can be contacted with the parallel guide face 251, the checks 4 can be most easily inserted into the check inserting portion 10.

Further, even in the case where the forward end portions 401 of the checks 4 are located on the front side of the check colliding face 252 at the time of inserting the check 4 from the upper side, the checks 4 are guided by the check transferring guide face 256 and the inclination upper end face 257 and inserted to the operator's side of the check colliding face 252 on the lower side. That is, as shown in FIG. 5(*b*), in the case where the checks 4 are set in the check insertion portion 10 from the upper side under the condition that the forward end portions 401 of the checks 4 are located on the front side of the check colliding face 252, the checks 4 drop onto the inclination upper end face 257 while the forward end portions 401 of the checks 4 are being laid along the guide face 256 for transferring the checks. Then, the checks 4 are guided to the rear side by the inclination upper end face 257 and dropped onto the operator's side of the check colliding face 252. Therefore, even when the checks 4 are dropped from the upper side onto the front side of the check colliding face 252, the checks 4 can be smoothly guided to the check colliding face 252.

In the case of processing long checks 4, the horizontal guide plate 26A may be drawn out to the rear side as shown in FIG. 1(*b*). When the horizontal guide plate 26A is drawn out to the rear side in this way, the bottom face 26 of the check inserting portion 10 can be extended to the rear side. Accordingly, longer rear portions of the checks 4 are protruded from the rear end portion of the check inserting portion 10. Therefore, it becomes possible to prevent the rear end portions of the checks 4 from dropping. Further, it becomes possible to prevent the long checks 4 from being inserted into the check insertion portion 10 in an unstable condition.

Next, when the checks 4 are inserted into the check inserting portion 10, it is detected by a sensor not shown arranged in the check inserting portion 10 that the checks 4 have been inserted. The pressing member 14 is rotated in the check inserting portion 10 by a command given from a high-ranking device or by an input given by the manual operation so that the checks 4 can be pressed onto the feeding roller 13 side as shown in FIG. 4. Under this condition, the feeding roller 13 is rotated. In the case where a plurality of checks 4 are inserted, the checks 4 are transferred in such an order that the check 4, which comes into contact with the feeding roller 13, is first transferred toward the check transferring passage 15. In this case, since the front end side guide face 253 is continuously formed on the check colliding face 252, the opening portion to the narrow conveyance passage 5 is expanded by the front side guide face 253. Accordingly, even when the forward end portions 401 of the checks 4 are wrinkled and the apparent thickness is increased, the checks 4 can be smoothly transferred to the narrow conveyance passage 5.

In the case of checks 4, the width of which is wide, or in the case of checks 4, which are thin and tender, the upper end portions laterally fall down as shown by the one-dotted chain line in FIG. 5(*a*). In the case where folds are formed in the lateral direction in the upper end portions of the checks 4, the checks 4 laterally fall down at the folds. In the case where the check colliding face 252 is formed connected to an upper end portion of the second side 25, forward end portions of the laterally falling portions 402 on the upper end side of the checks 4, which are transferred by the feeding roller 13, collide with the check colliding face 252 and it becomes impossible to transfer the checks 4.

In the present embodiment, the first side 24 and the second side 25, which are located on the right and the left, are formed so that the heights can be increased in the transferring direction. Accordingly, while the forward end portions of the laterally falling portions 402 on the upper end side of the checks 4 are being raised along the upper end edge 258 of the second side 25 and also along the upper end inclination face 241 for guiding a check insertion of the first side 24, the checks 4 are guided by the narrow check transferring passage 15.

A height of the check colliding face 252 is substantially two thirds of the height of the second side 25. On the upper side of the check colliding face 252, the guide face 256 for transferring the check is formed. A forward end portion of the laterally falling portion 402 on the upper side of the check 4 does not perpendicularly collide with the check colliding face 252 but collides with the check transferring guide face 256 which is inclined in the check transferring direction. Then the forward end portion of the laterally falling portion 402 is quickly guided toward the narrow check transferring passage 15 along the check transferring guide face 256.

On the other hand, on the first side 24, a check transferring guide face 245 is formed in an upper end portion of the forward end portion under the condition that a check transferring guide face 245 continues to the upper end inclination face 241 for guiding the check insertion. A forward end portion of the laterally falling portion 402 on the upper end side of the check 4 comes into contact with the check transferring guide face 245, which is inclined in the check transferring direction, and is guided toward the check transferring passage 15 along the check transferring guide face 245. Accordingly, even in the case where an upper side portion of the check 4 falls down laterally or in the case of a fold is formed in the lateral direction in the upper side portion of the check 4, the check 4 can be quickly transferred toward the narrow check transferring passage 15. FIG. 5 is a view showing an example in which the laterally falling portion 402 on the upper end side of the check 4 falls down onto the second side 25. However, even when the laterally falling portion 402 on the upper end side of the check 4 falls down onto the first side 24, the check can be smoothly guided as described above.

Another Embodiment

In this connection, in the above embodiment, the present invention is applied to a check transferring mechanism of the check processor. Of course, the medium transferring mechanism of the present invention can be applied to other mechanisms for transferring sheet-shaped mediums in addition to check processors.

In the above described embodiments, the check colliding face (first guide face) 252 is bent from the parallel guide face 251 by the angle of approximately 90°. Although the bending angle may be set to, for example, 105°, it is desirable that the bending angle is set to 90° so that a bundle of the checks can be inserted into the medium inserting portion without disrupting the aligned checks.

Further, the feeding roller 13 serves as the feeding member in the above described embodiments. Although a belt-shaped feeding member can be applied as the feeding member, it is desirable to employ a roller as the feeding member for simplify the mechanism and lowering costs.

What is claimed is:

1. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion, and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face; and the first guide face extends in a direction perpendicular to the medium transferring direction.

2. The medium transferring mechanism as set forth in claim 1, wherein:

a fourth guide face is formed so as to continue from the first guide face and extend so that an interval between the fourth guide face and a forward end portion of the first side face, which is opposed to the fourth guide face, is gradually decreased towards the medium transferring direction.

3. The medium transferring mechanism as set forth in claim 1, wherein a first fifth guide face is formed in at least one of an upper end portion of the first side face and an upper end portion of the second side face, and is upwardly inclined in a direction away from said first side face or said second side face.

4. The medium transferring mechanism as set forth in claim 1, wherein a sixth guide face is formed in at least one of a rear end portion of the first side face and a rear end portion of the second side face, and is rearwardly inclined in a direction away from said first side face or said second side face.

5. A medium processor comprising:

the medium transferring mechanism as set forth in claim 1;

a medium conveyance passage for conveying the sheet medium transferred from the medium transferring mechanism;

a conveyance roller operable to convey the sheet medium transferred into the medium conveyance passage;

an information reading section operable to read information recorded in the sheet medium conveyed in the medium conveyance passage; and a medium discharging portion operable to receive the sheet medium discharged from the medium conveyance passage after completion of reading information.

6. The medium transferring mechanism as set forth in claim 1, wherein the second side face includes a parallel guide face arranged in parallel with the first side face at a predetermined interval, wherein the parallel guide face includes an upper end inclination face and a height of the parallel guide face is higher than a height of said first side face.

7. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion, and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face; and heights of the first side face and the second side face from the bottom face are increased towards the medium transferring direction.

8. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion, and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face; and the medium transferring mechanism further comprises a guide plate attached to a rear end of the bottom face of the medium inserting portion and capable of being drawn out rearward.

9. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion, and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face; and a height of the first guide face is approximately two-thirds of a height of the second side face.

10. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion, and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face;

a first fifth guide face is formed in at least one of an upper end portion of the first side face and an upper end portion of the second side face, and is upwardly inclined in a direction away from said first side face or said second side face; and a check transferring guide face is formed continuous to said fifth guide face at a front portion of said medium insertion portion, said check transferring guide face being inclined in the medium transferring direction.

11. A medium transferring mechanism for transferring a sheet medium in a medium transferring direction, comprising:

a medium inserting portion into which the sheet medium is inserted, the medium inserting portion defined by a bottom face and by a first side face and a second side face which extend from the bottom face and are opposed to each other;

a medium transferring path formed at a forward end of the medium inserting portion and operable to guide the sheet medium in the medium transferring direction;

a feeding member disposed at a side of the first side face and operable to feed the sheet medium to the medium transferring path; and a pressing member disposed at a side of the second side face and operable to press the sheet medium against the feeding member, wherein:

a first guide face extending toward the first side face is formed at a forward end portion of the second side face;

a second guide face extending from the second side face so as to gradually get close to the medium transferring path towards the medium transferring direction is formed above the first guide face;

a third guide face inclined downward from a lower edge of the second guide face toward an upper edge of the first guide face is formed between the first guide face and the second guide face;

a first fifth guide face is formed in at least one of an upper end portion of the first side face and an upper end portion of the second side face, and is upwardly inclined in a direction away from said first side face or said second side face;

the first fifth guide face is formed in the upper end portion of the first side face and is upwardly inclined in a direction away from the second side face and wherein a second fifth guide face is formed in the upper end portion of the second side face and is upwardly inclined in a direction away from the first side face; and an opening width between upper end portions of said first fifth guide face and said second fifth guide face is approximately twice as wide as an interval between said first side face and said second side face.

* * * * *